US007246603B2

(12) United States Patent
Hattori

(10) Patent No.: US 7,246,603 B2
(45) Date of Patent: Jul. 24, 2007

(54) CONTROL UNIT FOR AN INTERNAL COMBUSTION ENGINE

(75) Inventor: Shogo Hattori, Kawachi-gun (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 10/553,121

(22) PCT Filed: Apr. 16, 2004

(86) PCT No.: PCT/JP2004/005500

§ 371 (c)(1),
(2), (4) Date: Oct. 14, 2005

(87) PCT Pub. No.: WO2004/094802

PCT Pub. Date: Nov. 4, 2004

(65) Prior Publication Data

US 2007/0017488 A1 Jan. 25, 2007

(30) Foreign Application Priority Data

Apr. 22, 2003 (JP) ..... 2003-116815

(51) Int. Cl.
*F02D 41/18* (2006.01)

(52) U.S. Cl. ..... 123/488; 123/478

(58) Field of Classification Search ..... 123/494, 123/478, 480, 488; 73/118.2
See application file for complete search history.

(56) References Cited

U.S. PATENT DOCUMENTS 4,463,601 A * 8/1984 Rask ..... 73/118.2
4,860,222 A * 8/1989 Schmidt et al. ..... 73/118.2
5,008,824 A * 4/1991 Clark et al. ..... 73/118.2
5,117,795 A * 6/1992 Ohsuga et al. ..... 123/494
5,572,976 A 11/1996 Minamitani et al. ..... 123/478
2003/0130785 A1* 7/2003 Ishikawa et al. ..... 701/110

FOREIGN PATENT DOCUMENTS

| | | | |
|---|---|---|---|
| EP | 0400 942 A1 | | 12/1990 |
| GB | 2070782 | * | 9/1981 |
| JP | 3-950 | | 1/1991 |
| JP | 4-15388 | | 3/1992 |
| JP | 7-167697 | | 7/1995 |
| JP | 7-247895 | | 9/1995 |

OTHER PUBLICATIONS

Microfilm of the specification and drawings annexed to the request of Japanese Utility Model Application No. 84576/1988 (Laid-open No. 22842/1989), Feb. 7, 1989.

* cited by examiner

*Primary Examiner*—T. M. Argenbright
(74) *Attorney, Agent, or Firm*—Squire, Sanders & Dempsey L.L.P.

(57) ABSTRACT

A control unit calculates a quantity of air that is taken into an engine from an output current from an air flow meter that is located downstream from a throttle valve. The control unit then determines the quantity of fuel to be injected for this quantity of air. A value obtained by multiplying by two an integral value of the quantity of air from the rise point of the quantity of air until the quantity of air reaches a peak value is used for calculating the injection quantity. This value is taken as the total integrated air intake quantity of an intake stroke, and this is then divided by a predetermined air-fuel ratio so as to provide the quantity of fuel to be injected.

3 Claims, 3 Drawing Sheets

CONTROL UNIT FOR AN INTERNAL COMBUSTION ENGINE

TECHNICAL FIELD

The present invention relates to a control unit that controls an injection quantity of fuel that is supplied to an internal combustion engine. Priority is claimed on Japanese Patent Application No. 2003-116815, filed Apr. 22, 2003, the content of which is incorporated herein by reference.

BACKGROUND ART

Conventionally, a method of controlling combustion in an internal combustion engine of a vehicle or the like is known (see, for example, Japanese Examined Patent Application, Second Publication No. H04-15388) in which the quantity of fuel that is injected is controlled so as to match the quantity of air that is taken in from the outside, and a mixture of air and fuel is ignited and combusted in accordance with the angle of rotation of the crankshaft.

Here, the technology that controls this fuel injection is disclosed in the aforementioned document. Specifically, a structure is employed to control the fuel injection into a multi cylinder engine in which a flow rate sensor is provided on an air intake passage between a throttle valve and an electromagnetic injection valve. A control circuit calculates a basic fuel injection quantity at predetermined timings based upon an average value of the flow rate of the intake air that is detected by the flow rate sensor. Fuel injection is then performed based on this basic injection quantity. The cylinders performing the air intake switch in sequence during one engine cycle. Variations in the intake air flow rate that are generated at this time are taken as deviations from the average value of the intake air flow rate, and deviation signals corresponding to these deviations are input directly into a voltage circuit of the electromagnetic injection valve. The fuel injection quantity is increased when there is a large deviation signal, and is decreased when there is a small deviation. For this calculation of the basic fuel injection quantity, compensation is performed using an air intake temperature sensor that detects the temperature of the air that is taken in and a cooling water temperature sensor that detects the temperature of the engine cooling water.

In order to improve combustion efficiency and response, it is desirable that the quantity of air that is actually taken into an internal combustion engine is measured at each intake, and that the optimal fuel injection quantity be determined for each air intake quantity. It is also desirable that the fuel injection is performed while the air intake valve is open and air is flowing. However, because the final fuel injection quantity is determined after the air intake valve has closed, if the fuel injection quantity is determined after the air quantity until the air intake has ended has been calculated, it is not possible to inject fuel while the air intake valve is open. If the fuel injection for an intake stroke is continued even after the air intake valve has been closed, the quantity of fuel in the fuel-air mixture that is supplied to the interior of the engine in the intake stroke is decreased. As a result, the air-fuel ratio becomes disproportionate. Moreover, because fuel remains inside the air intake manifold, the quantity of fuel in the fuel-air mixture that is supplied to the interior of the engine in the next intake stroke is increased, so that again the air-fuel ratio becomes disproportionate.

Accordingly, the present invention was conceived in order to solve the above described problems, and it is an object thereof to provide a control unit for an internal combustion engine that has a simple structure and enables a required quantity of fuel to be injected at an appropriate timing.

DISCLOSURE OF INVENTION

The present invention provides a control unit for an internal combustion engine that: detects, using a sensor that is located on a downstream side of a throttle valve on an air intake passage of an internal combustion engine, a flow rate of air that is taken into the internal combustion engine; calculates an injection quantity of fuel based on this air flow rate; and outputs a signal to an injector of the internal combustion engine such that this injection quantity of fuel is injected, wherein the injection quantity is calculated using a value obtained by multiplying a predetermined constant by an integral value that is obtained by integrating from the start of an air intake until a peak value is reached the air flow rate that increases as an intake stroke of the internal combustion engine progresses as a total integrated value of the air flow rate of that intake stroke.

According to the control unit for an internal combustion engine of this invention, the quantity of air that is taken into an internal combustion engine is calculated based upon detection values of a sensor, and an integral value from the start of the air intake until a peak value is reached is calculated. Here, because the profile of the changes in the quantity of air during an intake stroke is substantially constant, an injection quantity of fuel is calculated and the required injector control is performed with a value obtained by multiplying a predetermined constant by this integral value being taken as the air intake quantity of that intake stroke. Note that in the determination of the start of an air intake, for example, the size of the quantity of air can be used, while in the determination of a peak, for example, the amount of change in the quantity of air can be used.

It is preferable that in the control unit for an internal combustion engine of the present invention, the predetermined constant is 2.

According to the control unit for an internal combustion engine of this invention, once an integral value from the start of the air intake until a peak value is reached has been calculated, the quantity of fuel to be injected is calculated taking a value obtained by multiplying the integral value by 2 as the air intake quantity of a particular intake stroke.

The present invention provides a control unit for an internal combustion engine that: detects, using a sensor that is located on a downstream side of a throttle valve on an air intake passage of an internal combustion engine, a flow rate of air that is taken into the internal combustion engine; calculates an injection quantity of fuel based on this air flow rate; and outputs a signal to an injector of the internal combustion engine such that this injection quantity of fuel is injected, wherein the injection quantity is calculated using a value obtained by multiplying a predetermined constant by an integral value that is obtained by integrating from the start of an air intake until a peak value is reached the air flow rate that increases as an intake stroke of the internal combustion engine progresses as a total integrated value of the air flow rate of that intake stroke.

According to the control unit for an internal combustion engine of this invention, the quantity of air that is taken into an internal combustion engine is calculated based upon detection values of a sensor, and an integral value thereof is calculated at predetermined regular times. It is possible to determine based upon this integral value the fuel injection quantity that is required at that point in time. If the fuel injection quantity that has been determined in this manner is greater than the quantity of fuel that has already been injected, a command signal is output to the injector instructing that fuel be injected. Namely, the required fuel injection quantity is calculated at predetermined regular times and, if additional injection is required, control is performed such that fuel is injected.

BEST MODES FOR CARRYING OUT THE INVENTION

Figure 1:
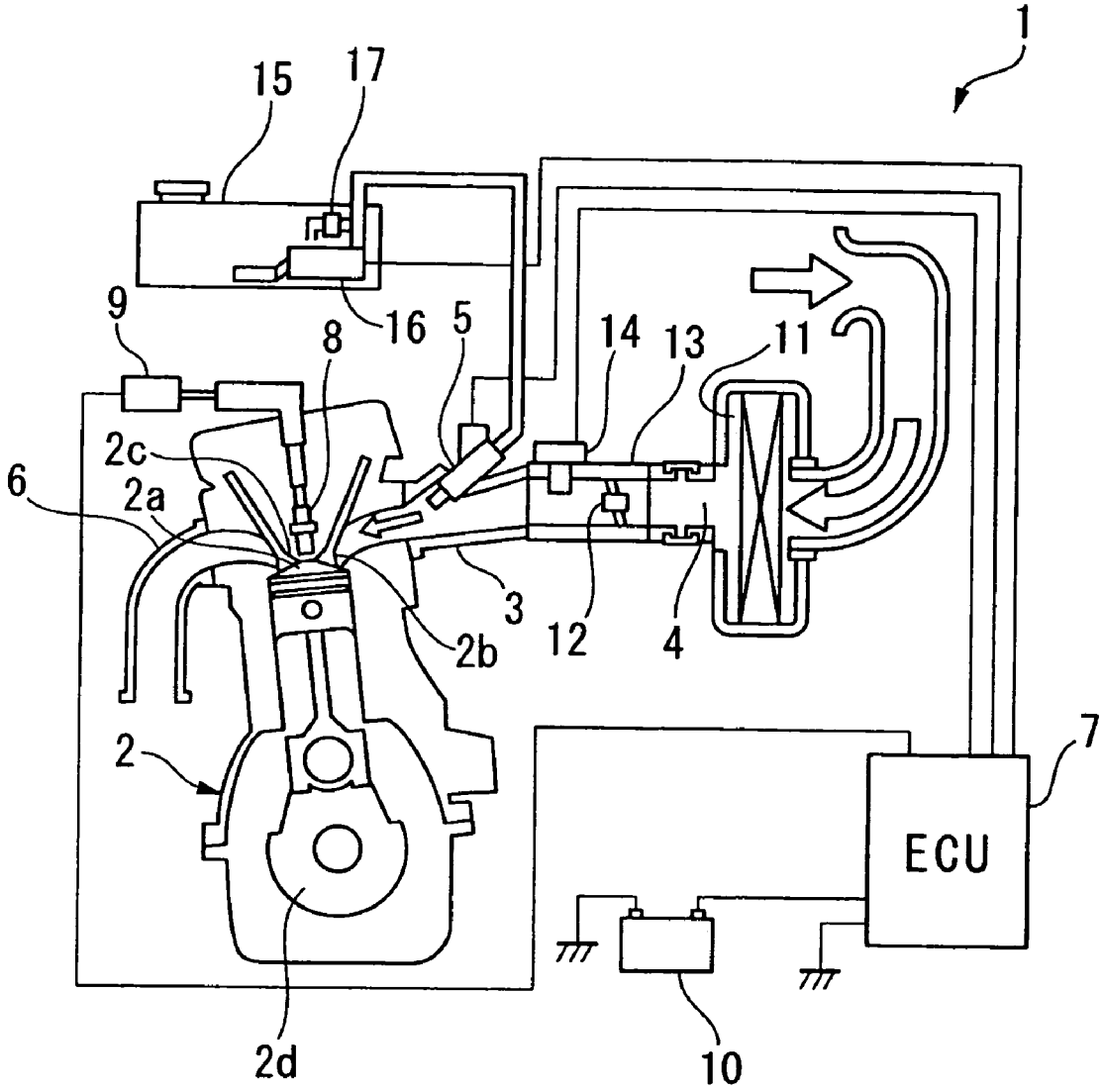
FIG. 1 is a schematic view showing an engine control system that includes a control unit of an embodiment of the present invention.

The first embodiment of the present invention will now be described in detail with reference made to the drawings. FIG. 1 is a schematic view showing an engine control system that is provided with the control unit for an internal combustion engine of the present embodiment.

An engine control system 1 of the present embodiment that is shown in FIG. 1 takes in air from an air intake passage 4 that is joined to an air intake manifold 3 of an engine 2, which is an internal combustion engine. This air is then mixed with fuel that is discharged from an injector 5 located in the air intake manifold 3. The fuel-air mixture is then combusted in a combustion chamber 2*a* of the engine 2. When the combustion gas is discharged after the combustion from an exhaust manifold 6, a control unit 7 controls an injection quantity and an injection timing of injected fuel in accordance with the quantity of air that is taken in (i.e., the air intake quantity) by the engine 2.

The air intake passage 4 has an air cleaner 11 and a throttle body 13 that is provided with a throttle valve 12 (i.e., a diaphragm valve) that performs air quantity adjustment on a downstream side of an air cleaner 11. The quantity of the air that is taken into the engine 2 through the air intake passage 4 is detected as a mass flow rate by an air flow meter 14 (i.e., a sensor) that is located on a downstream side from the throttle valve 12. As a result of the air flow meter 14 being located on the downstream side of the throttle valve 12, it is possible to subtract the quantity of air that is supplied between the throttle valve 12 and an air intake valve 2*b* from the air that is supplied through the throttle valve 12, and thereby accurately detect the quantity of air that is actually taken into the combustion chamber 2*a* of the engine 2. Note that if the air flow meter 14 is located on the throttle body 13, the number of setting steps can be reduced.

A preferred example of the air flow meter 14 of this embodiment is a sensor formed by depositing a thin platinum film on a silicon substrate and then energizing it such that the temperature of the thin platinum film is kept constant. If there is an increase in the mass of the air circulating around the thin platinum film, the quantity of heat that is lost via the air from the thin platinum film increases and the temperature of the thin platinum film drops proportionally. At this time, the air flow meter 14 causes the current being supplied to the thin platinum film to be increased so as to keep the temperature constant. In contrast, because there is a decrease in heat loss and the temperature of the thin platinum film rises if there is a decrease in the quantity of circulating air, the air flow meter 14 causes the current being supplied to the thin platinum film to be decreased. Because the current value increases or decreases proportionally to the increase or decrease in the mass of the air circulating around the thin platinum film, the air quantity can be measured by monitoring this current value. Note that, because it is possible to reduce the heat mass by using the above described type of air flow meter 14 compared to when wires made from platinum are used, a high response and a high degree of measurement accuracy are achieved.

The injector 5 injects fuel into the air flowing through the air intake manifold 3 using an opening and closing action of an electromagnetic injection valve. Fuel that has been pumped out from inside a fuel tank 15 by a fuel pump 16 and then undergone pressure adjustment by a regulator 17 is supplied to the injector 5.

The supply of fuel-air mixture to the combustion chamber 2*a* and the discharge thereof after combustion is performed by the air intake valve 2*b* and an exhaust valve 2*c* that are driven by a valve timing mechanism (not shown).

The fuel-air mixture is ignited by a spark plug 8. The spark plug 8 discharges electricity using high energy that is accumulated in an ignition circuit 9.

The control unit 7 that governs control in the engine control system 1 is also known as an electronic control unit (ECU) is provided with a central processing unit (CPU) and read only memory (ROM). The control unit 7 operates by receiving power supplied from a battery 10. This control unit 7 performs predetermined processing using as input data the current that is output from the air flow meter 14. The control unit 7 determines quantities of fuel that are supplied from the fuel pump 15 to the injector 5, injection quantities from the injector 5 as well as the injection timings thereof, the start timings of electrical discharges to the ignition circuit 9, and the ignition timings, and also outputs command signals to the respective sections.

Figure 2:
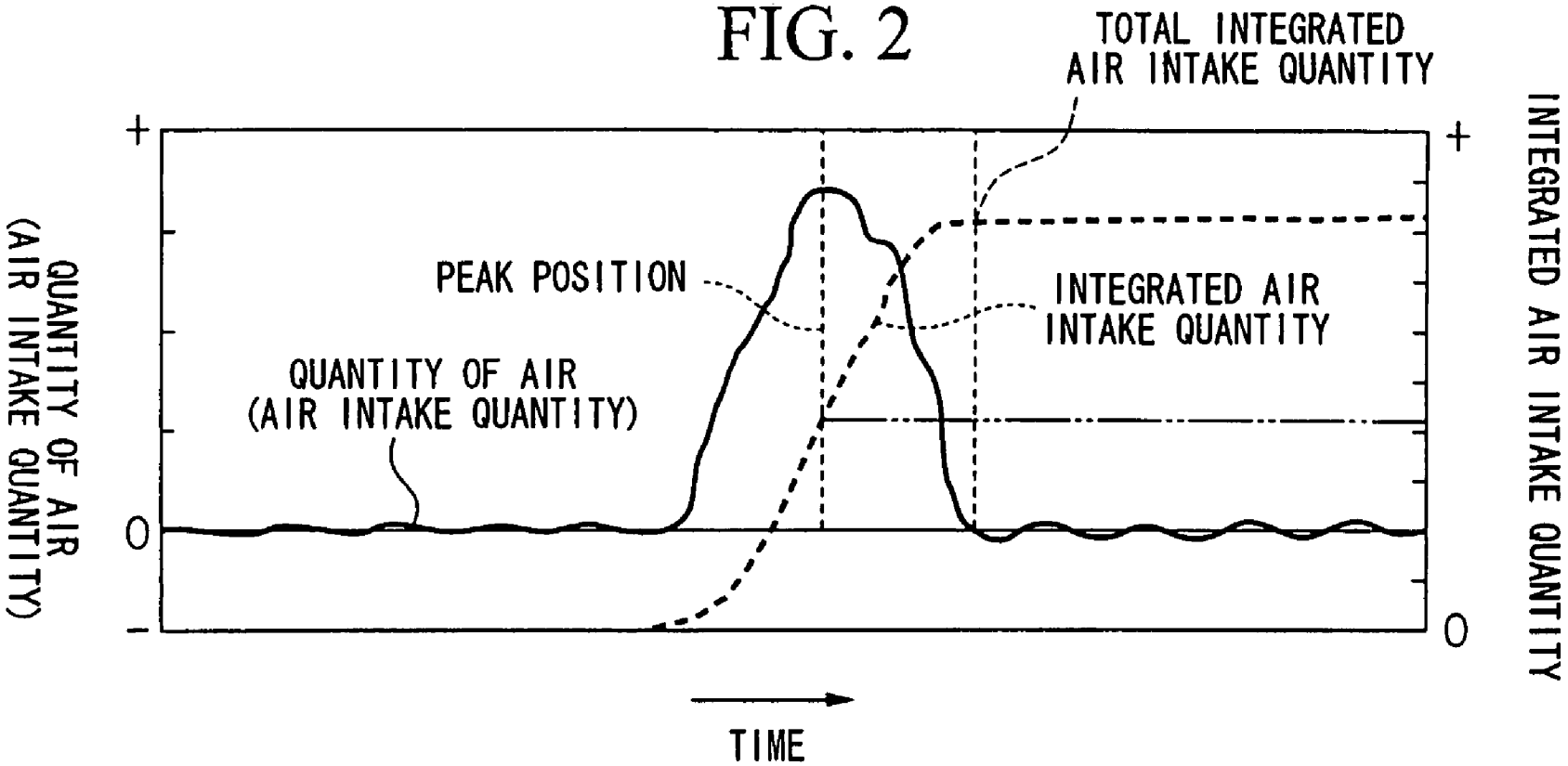
FIG. 2 is a view showing an example of changes in air, which changes in conjunction with an operation of an engine, and changes in an integrated air intake quantity.

Here, a description is given of the processing and the data that is processed by the control unit 7 using FIGS. 1 and 2. Note that FIG. 2 is a graph showing changes in air quantity, which changes in conjunction with the operation of the engine, the horizontal axis shows elapsed time, while the vertical axis shows intake air quantity.

In FIG. 2, the air quantity, which varies with elapsed time, is a value obtained by multiplying a predetermined coefficient by an output current from the air flow meter 14. The air quantity that is obtained is treated as a forward flow when it is greater than a predetermined threshold value (i.e., a reference value), and as a backward flow when it is less than this threshold value. Note that the term "forward flow" refers to when the air is flowing in the direction in which it is taken into the engine 2. The term "backward flow" refers to when the air is flowing in a reverse direction, namely, in the direction of the throttle valve 12. A backward flow is generated when the air intake valve 2*b* of the engine 2 is closed and the blocked air flows in a reverse direction. A pulse current is the state that occurs when this forward flow and backward flow alternate.

In some cases, the air intake valve 2*b* of the engine 2 is opened when the throttle valve 12 is in a slightly open state. However, in such cases, negative pressure is generated inside the air intake passage 4. Because this negative pressure remains even when the air intake valve 2*b* is closed, a slight flow of air entering along the throttle valve 12 may occur. The flow of air that is generated under such conditions is taken as a minimal current.

In addition, areas where the air quantity increases and exceeds the range of this pulse current and minimal current are areas where air is taken into the engine 2, and correspond to the intake stroke of the engine 2. When the air quantity exceeds the size of a pulse current and a minimal current, the start of an air intake (i.e., an air intake rise point) is taken as the starting point of this type of air quantity rise point. Because this starting point is determined by the timing at which the air intake valve 2*b* of the engine 2 opens (i.e., by a predetermined angle of a crankshaft 2*d*), it is possible to control the fuel injection timing and ignition timing taking this starting point as a reference point.

The end of an air intake (i.e., an air intake fall point) is taken as the point when the air quantity that has exceeded a peak value and is decreasing drops to zero. The peak position is taken as a position where the amount of change in the air quantity within a predetermined time is close to zero.

An integrated air intake quantity, which is an integrated value of the quantity of air taken into the engine 2 (i.e., the air intake quantity) from the start of an air intake until the end thereof, increases with the start of the air intake, and reaches a maximum value by the end of the air intake. Thereafter, this maximum value is taken as the total integrated air intake quantity. Here, an integrated air intake quantity corresponding to half the total integrated air intake quantity is substantially equivalent to the peak position of the air intake quantity.

In the control unit 7 of the present embodiment, it is observed that an integrated air intake quantity corresponding to half the total integrated air intake quantity is obtained by the air intake quantity peak position. A value obtained by multiplying the air intake integral value as far as the air intake quantity peak position by a factor of two is regarded as the total integrated air intake quantity. A fuel injection quantity is then determined by multiplying this by a predetermined coefficient. The reason why the total integrated air intake quantity is estimated using a peak position is because this leads to fewer variations in the air intake quantity before and after the peak position, which results in it being possible to calculate a fuel injection quantity with a high degree of accuracy. Moreover, the predetermined constant in order to estimate the total integrated air intake quantity using a peak position was set at a factor of 2, however, depending on the characteristics of the air intake valve 2*b* of the engine 2 and the like, a value between, for example, 1.8 to 2.2 may be used. This predetermined constant is determined in advance after the characteristics of the engine 2 have been examined, and is registered in the control unit 7.

As a result of the above, the control unit 7 has an air quantity calculating device that calculates an air quantity by multiplying an output current from the air flow meter 14 by a predetermined coefficient, an integrated air intake quantity calculating device that calculates an integral value of the air intake quantity during an intake stroke, a determining device that determines a peak position, and an injection quantity control device that calculates a fuel injection quantity in accordance with a value obtained by multiplying the air intake quantity as far as the peak position by a factor of 2 and also controls the injector 5 and the like.

Moreover, because the control unit 7 performs control such that the spark plug 8 is made to discharge electricity at a predetermined timing so as to combust a gas mixture of air and fuel, the control unit 7 also has an ignition control device that calculates and controls an electrical discharge time for the ignition circuit 9 in accordance with the air intake quantity and fuel quantity. Note that the control unit 7 may also be structured so as to not perform control of ignition. In this case, another control device is provided to function as an ignition control device.

Next, a description will be given of the control of the control unit 7 that is performed as interrupt processing in each fixed cycle after the engine 2 has started.

Firstly, the control unit 7 calculates an air quantity from an output current from the air flow meter 14. When the calculated air quantity exceeds the size of the pulse current or minimal current, the air intake is regarded as having started, and the air quantity at this time is taken as the air intake quantity. Moreover, in addition to this, the control unit 7 calculates an integral value for the air intake quantity. The integral value is obtained by adding the newly calculated air intake quantity to the total sum of the air intake quantity up until the previous time.

Furthermore, once the amount of change in the increase or decrease in the air intake quantity has been examined and it has been determined that the air intake quantity has reached its peak, the integral value from the start of the air intake to the air intake quantity corresponding to the peak position is multiplied by a factor of 2, and the obtained value is then taken as the total integrated air intake quantity for that intake stroke. This is then multiplied by a predetermined coefficient so that the fuel injection quantity is obtained. A command signal is then output to the injector 5 such that fuel is injected to correspond to this injection quantity.

In this manner, by estimating the total integrated air intake quantity and determining the fuel injection quantity before the air intake has actually ended, it is possible to end the injection of fuel while the air intake valve 2*b* is still open. At this time, by observing a peak position where there is little change in the air quantity and estimating the total integrated air intake quantity, it is possible to accurately calculate a fuel injection quantity.

Note that if, at the point in time when the air intake quantity reaches the peak position, the injector 5 has already begun injecting fuel, the control unit 7 controls the injector 5 such that the shortfall of fuel is injected. In contrast, if the injector 5 is not injecting fuel by the point when the peak position is reached, the injector 5 is opened and closed such that the necessary quantity of fuel is injected by the time the air intake valve 2*b* is closed.

Figure 3:
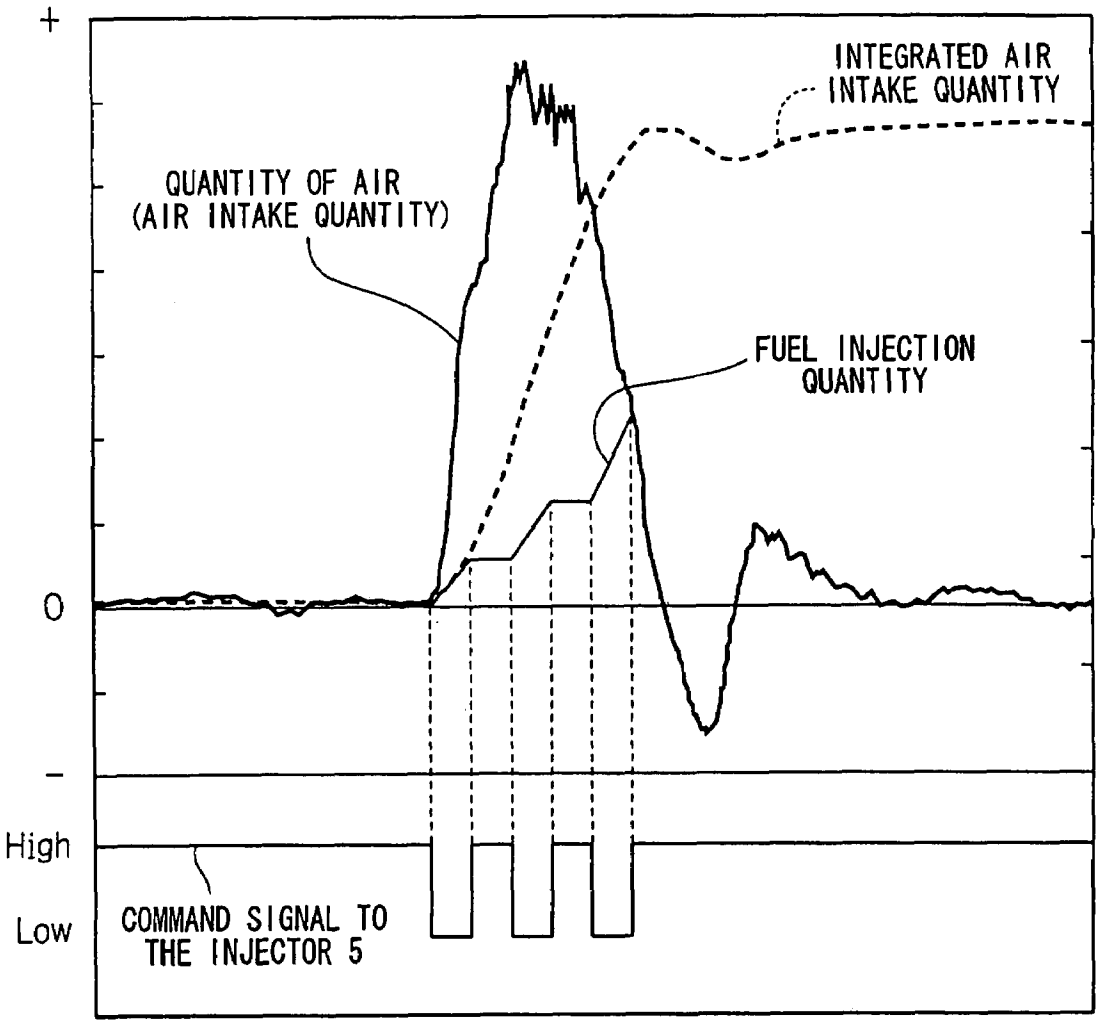
FIG. 3 is a view showing an example of changes in air, which changes in conjunction with an operation of an engine, changes in an integrated air intake quantity, and command signals to an injector.

Next, a second embodiment of the present invention will be described in detail with reference made to FIGS. 1 and 3. Note that any description overlapping with the above described embodiment will be omitted. FIG. 3 is a view showing changes in an air quantity and changes in a fuel injection quantity, which change in conjunction with an operation of an engine, and command signals to cause the electromagnetic injection valve of the injector 5 to open and close.

The control unit 7 of the present embodiment has a CPU and ROM and the like. This control unit 7 calculates a quantity of air flowing through the intake air passage 4 from output current from the air flow meter 14, and sequentially determines fuel injection quantities in accordance with the integrated amount of the air quantity taken into the engine 2 during air intake. If necessary, by causing a fuel injection from the injector 5 to be performed, the control unit 7 ends a fuel injection prior to the air intake valve 2*b* of the engine 2 closing.

An example of the opening and closing control of the electromagnetic injection valve of the injector 5 that is performed by the control unit 7 will now be described using FIG. 3. Note that the horizontal axis in FIG. 3 shows lapsed time. In addition, high level command signals to the injector 5 close the electromagnetic injection valve, while low level command signals open the electromagnetic injection valve.

The air intake quantity that is increased by the start of an intake stroke decreases after reaching a peak and drops to zero with the end of the air intake. The total integrated air intake quantity during the time gradually increases from the start of the air intake and reaches a maximum value when the air intake ends. The injection quantity of fuel that is injected so as to correspond to the air intake quantity that changes in this manner increases in stages from the start of the air intake until a point prior to the end of the air intake.

The control unit 7 regards the point when the air quantity exceeds a pulse current or minimal current and increases as the start of air intake, and calculates an air intake quantity from the air intake rise point and also calculates the integrated air intake quantity. In addition, the control unit 7 divides the integrated air intake quantity by the air-fuel ratio, and calculates a fuel injection quantity for that integrated air intake quantity.

In contrast, the control unit 7 injects fuel into the air intake passage 4 by outputting a command signal to the injector 5 and opening the electromagnetic injection valve (i.e., the first injection stroke shown in FIG. 3). As a result, the fuel injection quantity rises up from zero and increases. While injecting fuel, the control unit 7 determines the fuel injection quantity that is actually injected from an injection time and injection quantity per unit time of the injector 5.

Here, because the intake of air is continued during this time, the integrated air intake quantity increases and the required fuel injection quantity also increases. Therefore, the required fuel injection quantity that increases with elapsed time and the fuel injection quantity that is actually injected are calculated at a predetermined sampling time. When the two match, a command signal is output instructing that the injection by the injector 5 is halted.

Furthermore, if the integrated air intake quantity also increases subsequently to this, after a predetermined length of time has elapsed, the control unit 7 calculates a difference that is obtained by subtracting the injection quantity of the fuel that has already been injected from a fuel injection quantity obtained by multiplying the integrated air intake quantity at that time by a predetermined air-fuel ratio. If this difference is a positive value, because this shows that the integrated air intake quantity is increasing and the fuel injection quantity is insufficient, the control unit 7 once again outputs a command signal to the injector 5 and recommences fuel injection (i.e., a second injection stroke). Because the quantity of fuel that is actually injected is calculated here as well, the accumulated injection quantity from the start of the air intake is determined, a comparison is made between this accumulated injection quantity and the required injection quantity determined from the integrated air intake quantity, and fuel is injected from the injector 5 until the two match.

Subsequently, in the same manner, the fuel shortfall is checked at regular predetermined times, and a command signal instructing fuel injection is output (for example, a third injection stroke). When there is a match between the required fuel injection quantity determined from the air intake quantity and the accumulated injection quantity that has actually been injected, a command signal is output instructing the injector 5 to end fuel injection. Accordingly, the air intake quantity falls, and once it has been confirmed that the air intake has ended, the control unit 7 prohibits fuel injection and establishes settings such that fuel is not injected until the start of the next air intake is confirmed.

By controlling fuel injection in this manner, it is possible to end fuel injection before the air intake has ended. At this time, by causing fuel to be injected on several occasions as it is required, it is possible to cause the optimal quantity of fuel to be injected in accordance with the changes in the air intake quantity. Note that, in the example shown in FIG. 3, the integrated air intake quantity still increases even after the third injection stroke has ended, however, because the air intake is in its ending stage, the amount of the increase is small and there is no marked variation in the air-fuel ratio of the fuel and the air. Moreover, if the air intakes ends while fuel is being injected, the fuel injection can be halted rapidly.

Here, it is also possible for the second and subsequent fuel injections to be performed at predetermined regular times without any insufficiency of the fuel being determined. It is also possible for injection quantity per unit time of the injector 5 to be varied in each injection stroke.

Furthermore, in the first injection stroke, if a larger quantity of fuel is injected in the first injection stroke than the required injection quantity that was calculated based upon the air intake quantity, it is possible to reduce the number of injection strokes occurring during one intake stroke. In this case, it is possible to decide the injection quantity in the first intake stroke by referring to the total integrated air intake quantity in the previous intake stroke.

INDUSTRIAL APPLICABILITY

The present invention relates to a control unit for an internal combustion engine that: detects, using a sensor that is located on a downstream side of a throttle valve on an air intake passage of an internal combustion engine, a quantity of air that is taken into the internal combustion engine; calculates an injection quantity of fuel based on this quantity of air; and outputs a signal to an injector such that this injection quantity of fuel is injected, wherein the injection quantity is calculated using a value obtained by multiplying a predetermined constant by an integral value that is obtained by integrating from the start of an air intake until a peak value is reached the quantity of air that increases as an intake stroke of the internal combustion engine progresses as a total integrated value of the quantity of air of that intake stroke.

According to the control unit for an internal combustion engine of the present invention, because an air intake quantity is detected using a sensor that is located on the engine side of the throttle valve, and the fuel injection quantity is calculated based upon an integral value of the total sum of the quantity of air that is taken into the internal combustion engine from the start of the air intake until a peak value thereof is reached, it is possible to accurately calculate and inject the fuel injection quantity that is required in an intake stroke prior to that intake stroke being completed.

According to the control unit for an internal combustion engine of the present invention, by taking as the air intake quantity of a particular intake stroke a value obtained by multiplying by a factor of two the integral value from the start of the air intake until a peak value thereof is reached, a fuel injection quantity can be accurately calculated by a simple processing.

The present invention relates to a control unit for an internal combustion engine that: detects, using a sensor that is located on a downstream side of a throttle valve on an air intake passage of an internal combustion engine, a quantity of air that is taken into the internal combustion engine; calculates an injection quantity of fuel based on this quantity of air; and outputs a signal to an injector of the internal combustion engine such that this injection quantity of fuel is injected, wherein an integral value of the quantity of air that increases as an intake stroke of the internal combustion engine progresses is calculated until the air intake ends, and during a period from the start of the air intake until the end of the air intake, an injection quantity of fuel is determined based upon the integral value at regular predetermined times, and a signal is output to the injector such that the injection quantity matches an accumulated value from the start of the air intake.

According to the control unit for an internal combustion engine of the present invention, because an integral value of the quantity of air that has been taken in is determined at regular predetermined times and fuel injection is performed when it is necessary, it is possible to accurately inject the injection quantity of fuel that is required in a particular intake stroke before that intake stroke has ended. Moreover, it is possible to deal flexibly with minute variations in the quantity of air that is taken in.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as limited by the foregoing description and is only limited by the scope of the appended claims.

The invention claimed is:

1. A control unit for an internal combustion engine that:

detects, using a sensor that is located on a downstream side of a throttle valve on an air intake passage of the internal combustion engine, an air flow rate that is taken into the internal combustion engine;

calculates an injection quantity of fuel based on the air flow rate; and outputs a signal to an injector of the internal combustion engine such that this injection quantity of fuel is injected, wherein the injection quantity is calculated using a value obtained by multiplying a predetermined constant by an integral value that is obtained by integrating from the start of an air intake until a peak value is reached the air flow rate that increases as an intake stroke of the internal combustion engine progresses as a total integrated value of the air flow rate of that intake stroke.

2. The control unit for an internal combustion engine according to claim 1, wherein the predetermined constant is 2.

3. A control unit for an internal combustion engine that:

detects, using a sensor that is located on a downstream side of a throttle valve on an air intake passage of an internal combustion engine, a flow rate of air that is taken into the internal combustion engine;

calculates an injection quantity of fuel based on this air flow rate; and outputs a signal to an injector of the internal combustion engine such that this injection quantity of fuel is injected, wherein an integral value of the air flow rate that increases as an intake stroke of the internal combustion engine progresses is calculated until the air intake ends, and during a period from the start of the air intake until the end of the air intake, an injection quantity of fuel is determined based upon the integral value at regular predetermined times, and a signal is output to the injector such that the injection quantity matches an accumulated value from the start of the air intake.

* * * * *